US010869152B1

(12) United States Patent
Walsh et al.

(10) Patent No.: US 10,869,152 B1
(45) Date of Patent: Dec. 15, 2020

(54) FOVEATED AUDIO RENDERING

(71) Applicant: DTS, Inc., Calabasas, CA (US)

(72) Inventors: Martin Walsh, Scotts Valley, CA (US); Edward Stein, Soquel, CA (US)

(73) Assignee: DTS, Inc., Calabasas, CA (US)

( * ) Notice: Subject to any disclaimer, the term of this patent is extended or adjusted under 35 U.S.C. 154(b) by 0 days.

(21) Appl. No.: 16/435,754

(22) Filed: Jun. 10, 2019

Related U.S. Application Data

(60) Provisional application No. 62/855,225, filed on May 31, 2019.

(51) Int. Cl.

| | |
|---|---|
| ***H04S 7/00*** | (2006.01) |
| ***H04R 3/12*** | (2006.01) |
| ***H04S 3/00*** | (2006.01) |
| ***H04R 5/04*** | (2006.01) |

(52) U.S. Cl.
CPC ..... *H04S 7/303* (2013.01); *H04R 3/12* (2013.01); *H04R 5/04* (2013.01); *H04S 3/002* (2013.01); *H04S 2400/01* (2013.01); *H04S 2420/01* (2013.01)

(58) Field of Classification Search
None
See application file for complete search history.

(56) References Cited

U.S. PATENT DOCUMENTS 8,428,269 B1 4/2013 Brungart et al.
9,706,292 B2 7/2017 Duraiswami et al.
9,826,328 B2 11/2017 Mehta et al.
9,973,874 B2 5/2018 Edward et al.
2013/0259312 A1* 10/2013 Lyons ..... H04N 21/4223 382/103
2014/0079225 A1 3/2014 Jarske et al.
(Continued)

FOREIGN PATENT DOCUMENTS

EP 2842529 A1 3/2015

OTHER PUBLICATIONS

Silzle, Andreas. "Selection and tuning of HRTFs". pp. 1-14. May 10, 2002. https://toneprints.com/media/1018578/silzle_2002_selection_tuni.pdf. (Year: 2002).*
(Continued)

*Primary Examiner* — Qin Zhu
(74) *Attorney, Agent, or Firm* — Schwegman Lundberg & Woessner, P.A.

(57) ABSTRACT

The present subject matter provides technical solutions to technical problems facing audio virtualization. To reduce the technical complexity and computational intensity facing audio virtualization, a technical solution includes rendering audio objects binaurally with differing quality levels, where the quality level for each audio source may be selected based on their position relative to the user's field of view. In an example, this technical solution reduces technical complexity and computational intensity by reducing the audio quality for audio sources outside of a user's central field of vision. In an example, high quality audio rendering may be applied to sound objects within this strong central visual acuity area. These technical solutions reduce processing over higher complexity systems, and provides potential for much higher quality rendering at a reduced technical and computational cost.

23 Claims, 5 Drawing Sheets

(56) References Cited

U.S. PATENT DOCUMENTS

| | | | | |
|---|---|---|---|---|
| 2014/0176813 | A1* | 6/2014 | Conness | H04N 5/60 348/738 |
| 2014/0205134 | A1* | 7/2014 | Yagihashi | H04R 3/04 381/387 |
| 2014/0233917 | A1 | 8/2014 | Xiang | |
| 2015/0223002 | A1 | 8/2015 | Mehta et al. | |
| 2016/0044430 | A1* | 2/2016 | McGrath | H04S 1/005 381/17 |
| 2016/0073215 | A1 | 3/2016 | De Bruijn et al. | |
| 2016/0105757 | A1* | 4/2016 | Vennstrom | G06F 3/167 381/303 |
| 2017/0045941 | A1* | 2/2017 | Tokubo | G06F 3/167 |
| 2017/0366912 | A1 | 12/2017 | Stein et al. | |
| 2017/0366913 | A1 | 12/2017 | Stein et al. | |
| 2017/0366914 | A1 | 12/2017 | Stein et al. | |
| 2018/0077511 | A1 | 3/2018 | Mehta | |
| 2018/0109901 | A1* | 4/2018 | Laaksonen | H04S 7/304 |
| 2019/0007781 | A1* | 1/2019 | Peters | G06F 3/165 |
| 2019/0313200 | A1* | 10/2019 | Stein | G06F 3/04845 |

OTHER PUBLICATIONS

"International Application Serial No. PCT/US2019/036315, International Search Report dated Sep. 9, 2019", 5 pgs.
"International Application Serial No. PCT/US2019/036315, Written Opinion dated Sep. 9, 2019", 6 pgs.

* cited by examiner

FOVEATED AUDIO RENDERING

RELATED APPLICATION AND PRIORITY CLAIM

This application is related and claims priority to U.S. Provisional Application No. 62/855,225, filed on May 31, 2019 and entitled "Foveated Audio Rendering," the entirety of which is incorporated herein by reference.

TECHNICAL FIELD

The technology described herein relates to systems and methods for spatial audio rendering.

BACKGROUND

An audio virtualizer may be used to create a perception that individual audio signals originate from various locations (e.g., are localized in 3D space). The audio virtualizer may be used when reproducing audio using multiple loudspeakers or using headphones. A technique for virtualizing an audio source includes rendering that audio source based on the audio source location relative to a listener. However, rendering an audio source location relative to a listener may be technically complex and computationally expensive, especially for multiple audio sources. What is needed is an improved audio virtualizer.

DESCRIPTION OF EMBODIMENTS

The present subject matter provides technical solutions to technical problems facing audio virtualization. To reduce the technical complexity and computational intensity facing audio virtualization, a technical solution includes rendering audio objects binaurally with differing quality levels, where the quality level for each audio source may be selected based on their position relative to the user's field of view. In an example, this technical solution reduces technical complexity and computational intensity by reducing the audio quality for audio sources outside of a user's central field of vision. This solution takes advantage of a user's reduced ability to verify accuracy of an audio rendering if the user cannot see where the object audio was supposed to be coming from. In general, humans have a strong visual acuity typically limited to an approximately sixty-degree arc centered in a gaze direction. The portion of the eye responsible for this strong central visual acuity is the fovea, and as used herein, foveated audio rendering refers to rendering audio objects based on audio object position relative to this strong central visual acuity area. In an example, high quality audio rendering may be applied to sound objects within this strong central visual acuity area. Conversely, lower complexity algorithms may be applied to other areas where the objects being rendered cannot be seen, and the user will be unlikely or unable to notice any localization errors associated with the lower complexity algorithms. These technical solutions reduce processing over higher complexity systems, and provides potential for much higher quality rendering at a reduced technical and computational cost.

The detailed description set forth below in connection with the appended drawings is intended as a description of the presently preferred embodiment of the present subject matter, and is not intended to represent the only form in which the present subject matter may be constructed or used. The description sets forth the functions and the sequence of steps for developing and operating the present subject matter in connection with the illustrated embodiment. It is to be understood that the same or equivalent functions and sequences may be accomplished by different embodiments that are also intended to be encompassed within the spirit and scope of the present subject matter. It is further understood that the use of relational terms (e.g., first, second) are used solely to distinguish one from another entity without necessarily requiring or implying any actual such relationship or order between such entities.

Figure 1:
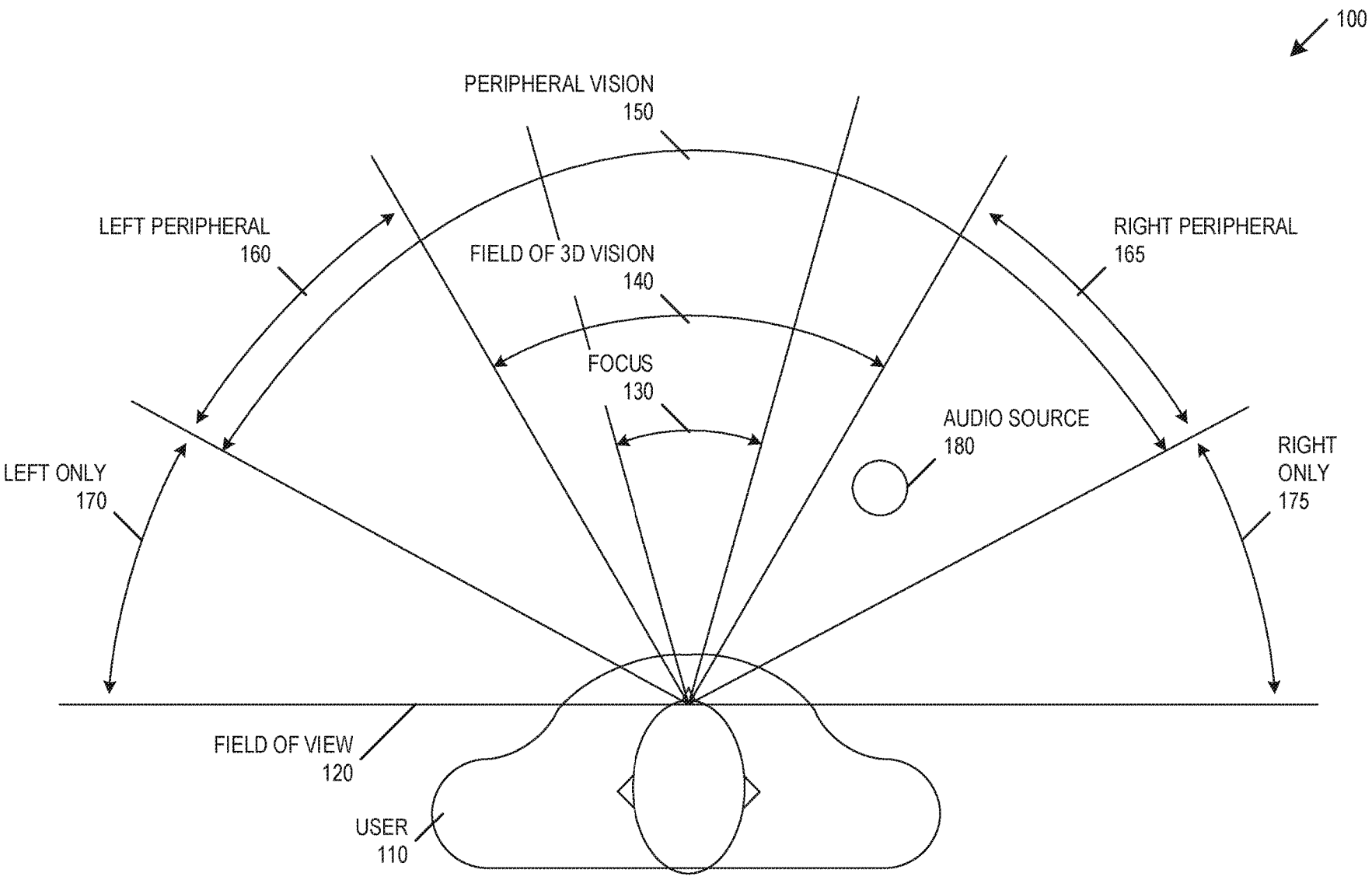
FIG. 1 is a diagram of a user vision field, according to an embodiment.

FIG. 1 is a diagram of a user vision field 100, according to an embodiment. A user 110 may have an associated total field of view 120. The total field of view 120 may be subdivided into multiple regions. A region of focus 130 may be directly in front of a user, where the region of focus 130 may include approximately thirty degrees of the central portion of the user's total field of view 120. A field of 3D vision 140 may include and extend beyond the region of focus 130 to include approximately sixty degrees of the central portion of the user's total field of view 120. In an example, a user 110 may view objects in 3D within the field of 3D vision 140. A field of peripheral vision 150 may include and extend beyond the field of 3D vision 140 to include approximately one hundred and twenty degrees of the central portion of the user's total field of view 120. In addition to the field of 3D vision 140, the field of peripheral vision 150 may include a left peripheral region 160 and a right peripheral region 165. While both eyes are able to observe objects in the left and right peripheral regions 160 and 165, the reduced visual acuity in these regions results in those objects being viewed in 2D. The field of view 120 may also include a left only region 170 that is blind to the right eye, and may include a right only region 175 that is blind to the left eye.

One or more audio sources 180 may be positioned within a user's field of view 120. Audio from the audio source 180 may travel a separate acoustic path to each ear drum of the user 110. The separate paths from audio source 180 to each ear drum creates unique source-to-eardrum frequency response and interaural time difference (ITD). This frequency response and ITD may be combined to form an acoustic model, such as a binaural Head-Related Transfer Function (HRTF). Each acoustic path from audio source 180 to each ear drum of the user 110 may have a unique pair of corresponding HRTFs. Each user 110 may have a slightly different head shape or ear shape, so each user 110 may have a correspondingly slightly different HRTF according to head shape or ear shape. To reproduce sound accurately from a location of a specific audio source 180, HRTF values may be measured for each user 110, and the HRTF may be convolved with the audio source 180 to render the audio from the location of the audio source 180. While HRTFs provide accurate reproduction of an audio source 180 from a specific location for a specific user 110, it is impractical to measure every type of sound from every location from every user to generate all possible HRTFs. To reduce the number of HRTF measurements, HRTF pairs may be sampled at specific locations, and HRTFs may be interpolated for locations between the sampled locations. The quality of audio reproduced using this HRTF interpolation may be improved by increasing the number of sample locations or by improving HRTF interpolation.

HRTF interpolation may be implemented using various methodologies. In an embodiment, HRTF interpolation may include creating a multichannel speaker mix (e.g., vector-based amplitude panning, Ambisonics) and virtualizing speakers using generalized HRTFs. This solution may be efficient but provide lower quality, such as when ITDs and HRTFs are incorrect and result in reduced frontal imaging. This solution may be used for multichannel games, multichannel movies, or interactive 3D audio (I3DA). In an embodiment, HRTF interpolation may include a linear combination of minimum phase HRTFs and an ITD for each audio source. This may provide improved low frequency accuracy through improved accuracy of ITDs. However, this may also reduce performance of HRTF interpolation without a dense database of HRTFs (e.g., at least 100 HRTFs), and may be more computationally expensive to implement. In an embodiment, HRTF interpolation may include a combination of frequency domain interpolation and personalized HRTFs for each audio source. This may focus on more accurate recreation of interpolated HRTF audio source locations and may provide improved performance for frontal localization and externalization, but may be computationally expensive to implement.

The selection of a combination of HRTF locations and interpolations based on a location of an audio source 180 may provide improved HRTF audio rendering performance. To improve the performance of HRTF rendering while reducing computational intensity, a highest quality HRTF rendering may be applied to audio objects within a region of focus 130, and the HRTF rendering quality may be reduced for areas within the field of view 120 that are increasingly distant from the region of focus 130. This selection of HRTFs based on subdivided regions within the field of view 120 may be used to select reduced audio quality rendering in specific regions, where the reduced audio quality rendering will not be recognized by a user. Additionally, seamless transitions may be used at transitions of subdivided regions within the field of view 120 to reduce or eliminate the ability of a user 110 to detect a transition between regions. The regions within and outside of the field of view 120 may be used to determine a rendering quality applied to each sound source, such as described with respect to FIG. 2, below.

Figure 2:
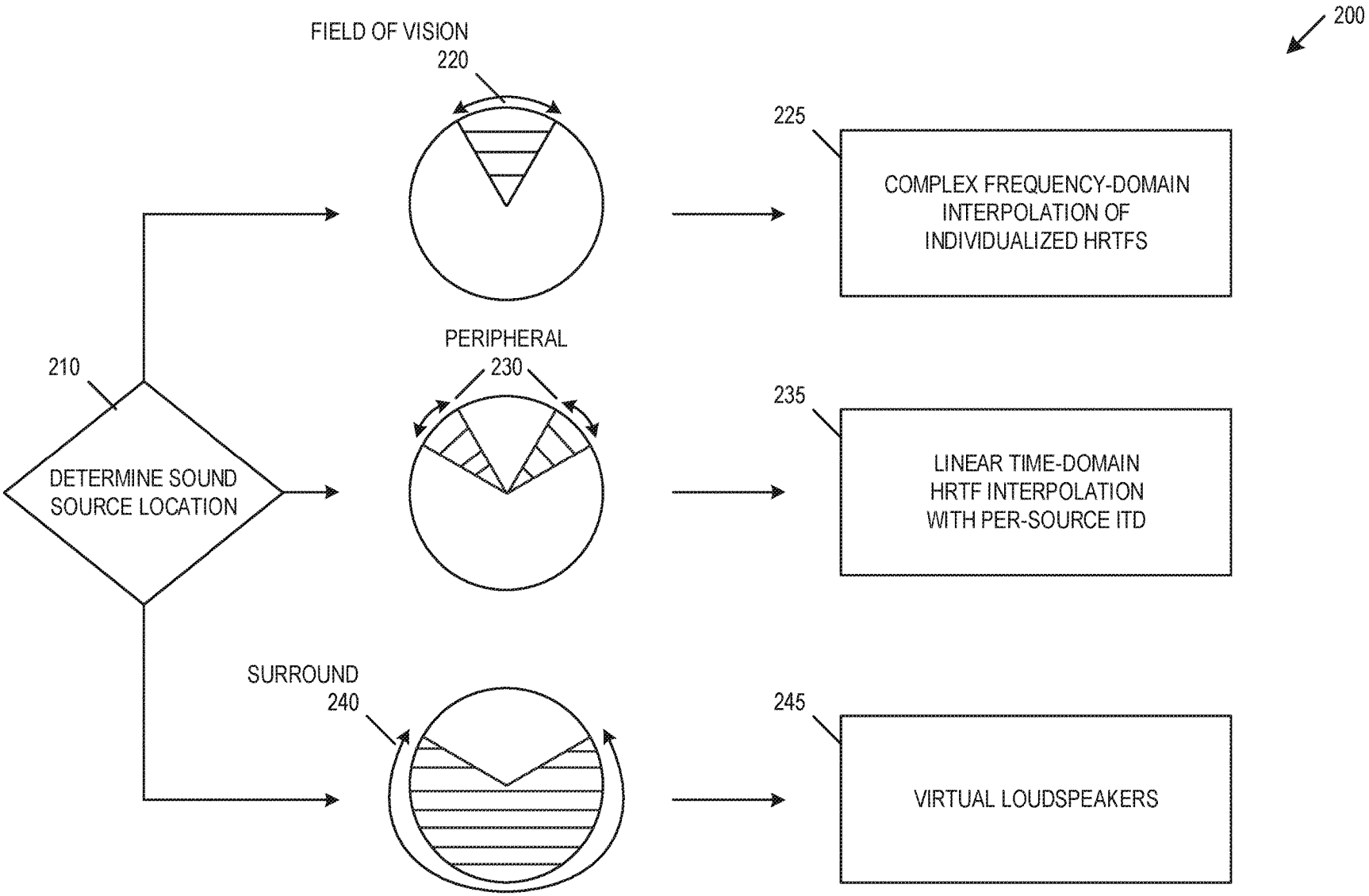
FIG. 2 is a diagram of an audio quality rendering decision engine, according to an embodiment.

FIG. 2 is a diagram of an audio quality rendering decision engine 200, according to an embodiment. Decision engine 200 may begin by determining a sound source location 210. When one or more sound source locations are within a field of vision 220, the sound sources may be rendered based on a complex frequency-domain interpolation of individualized HRTFs 225. When one or more sound source locations are outside of the field of vision 220 but within a peripheral region 230, the sound sources may be rendered based on a linear time-domain HRTF interpolation with per-source ITDs 235. When one or more sound source locations are outside of the field of vision 220 and outside the peripheral region 230 but within a surround region 240, the sound sources may be rendered based on virtual loudspeakers 245.

Audio sources on or near borders between two regions may be interpolated based on a combination available HRTF measurements, visual region boundaries, or visual region tolerances. In an embodiment, an HRTF measurement may be taken on each transition between the field of vision 220, the peripheral region 230, and the surround region 240. By taking HRTF measurements on transition between regions, the audio quality rendering decision engine 200 may provide a seamless transition between one or more rendering qualities between adjacent regions, such that the transition that is audibly transparent to the user. The transition may include a transition angle, such as the conical surface of a sixty-degree conical section centered in front of a user. The transition may include a transition region, such as five degrees on either side of the conical surface of a sixty-degree conical section centered in front of a user. In an embodiment, the location of the transition or transition region is determined based on the location of nearby HRTF measurements. For example, the transition point between the field of vision 220 and the peripheral region 230 may be determined based on HRTF measurement locations closest to an approximately sixty-degree arc centered in front of a user. The determination of the transition may include aligning the result of the two adjacent rendering qualities so that they provide sufficiently similar results as to achieve seamless audible continuity. In an example, a seamless transition includes using an HRTF measured at the boundary, and a per-source ITD may use the measured HRTF as a baseline rendering while ensuring a common ITD is applied.

A visual region tolerance may be used in combination with available HRTF measurements to determine visual region boundaries. For example, if an HRTF is outside the field of vision 220 but within a visual region tolerance for the field of vision 220, the HRTF location may be used as the boundary between the field of vision 220 and the peripheral region 230. The rendering of audio sources using HRTFs is simplified by taking HRTF measurements on region transitions or by varying regions based on available HRTF measurements, such as by reducing the number of HRTF measurements or by avoiding the need to implement HRTF rendering models over an entire user's acoustic sphere.

The use of one or more transitions or transition regions may provide detectability of the systems and methods described herein. For example, implementation of an HRTF transition may be detected by detecting audio transitions at one or more of the transition regions. Additionally, the ITD may be measured accurately and compared to with cross-fading between regions. Similarly, the frequency domain HRTF interpolation may be observed and compared with linear interpolation over frontal regions.

Figure 3:
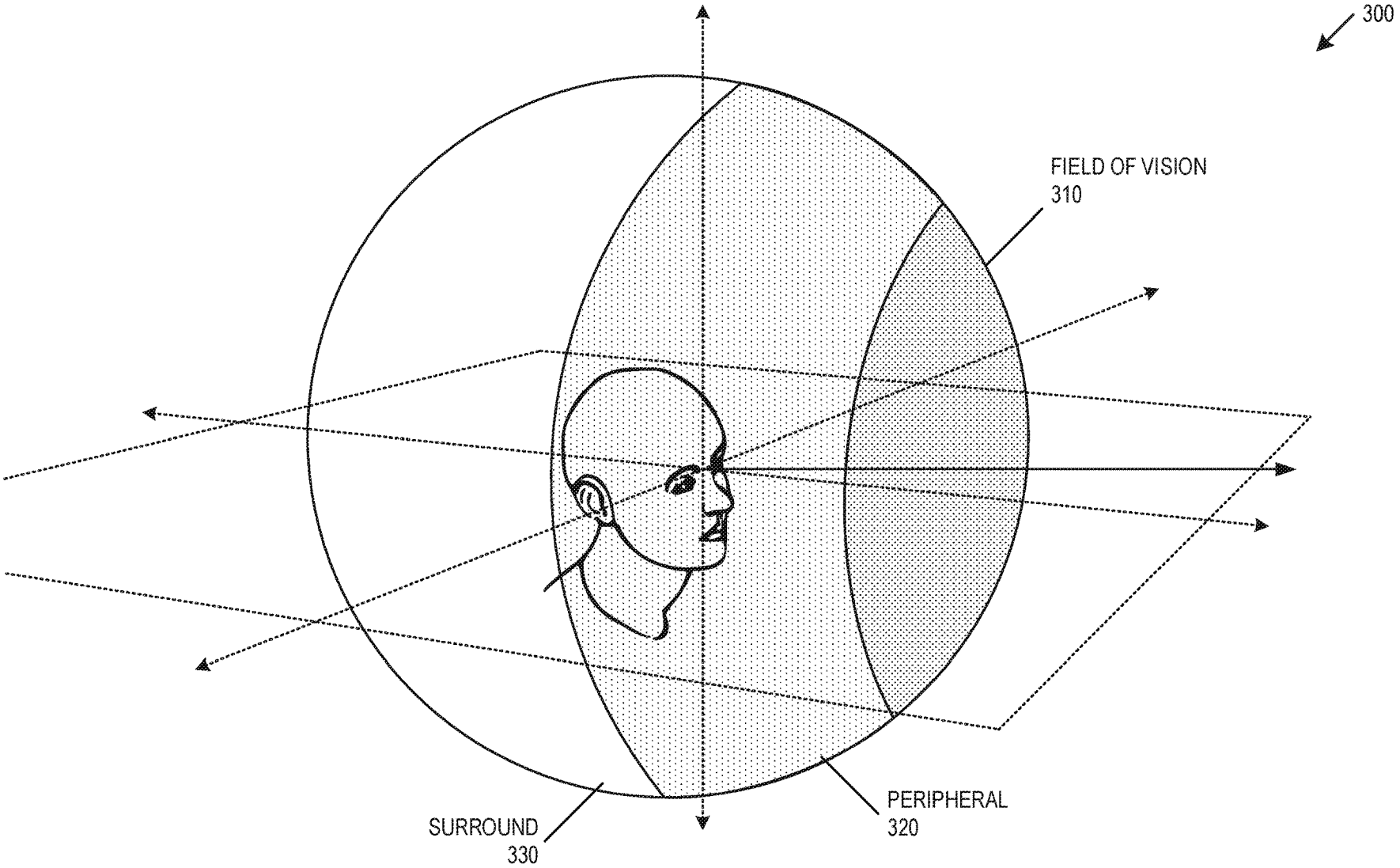
FIG. 3 is a diagram of a user acoustic sphere, according to an embodiment.

FIG. 3 is a diagram of a user acoustic sphere 300, according to an embodiment. Acoustic sphere 300 may include a field of vision region 310, which may extend the field of vision 220 to a sixty-degree cone of vision. In an example, audio sources within the field of vision region 310 may be rendered based on frequency domain HRTF interpolation, and may include a compensation based on a determined ITD. In particular, HRTF interpolation may be performed to derive one or more intermediate HRTF filters from adjacent measured HRTFs, an ITD may be determined based on measurements or formula, and an audio object may be filtered based on the interpolated HRTF and associated ITD. Acoustic sphere 300 may include a peripheral of vision region 310, which may extend the peripheral region 230 to a one-hundred-and-twenty-degree cone of vision. In an example, audio sources within the peripheral region 230 may be rendered based on a time domain head-related impulse response (HRIR) interpolation, and may include a compensation based on a determined ITD. In particular, time domain HRIR interpolation may be performed to derive intermediate HRTF filter from one or more measured HRTFs, the ITD may be derived based on measurements or formula, and the audio object may be filtered with the interpolated HRTF and associated ITD. In an example, the HRIR sampling may not include a uniform sampling. A surround audio rendering may be applied to a surround region 330, where surround region 330 may be outside of both the peripheral region 320 and the field of vision region 310. In an example, audio sources within the surround region 330 may be rendered based on vector-based amplitude panning across a loudspeaker array, such as using HRIRs measured at one or more loudspeaker locations. While three zones are shown and discussed with respect to FIG. 3, additional zones may be identified or used to render one or more audio sources.

Acoustic sphere 300 may be especially useful in rendering audio for one or more virtual reality or mixed reality applications. For virtual reality applications, the user is primarily focused on one or more objects in the gaze direction. By using the acoustic sphere 300 and audio rendering described herein, the higher quality rendering in virtual reality may be perceived to be happing over a larger space around a virtual reality user. For mixed reality applications (e.g., augmented reality applications) real sound sources may be mixed with virtual sound sources to improve HRTF rendering and interpolation. For virtual reality or mixed reality applications, both audio and visible quality may be improved for sound-generating objects within a gaze direction.

Figure 4:
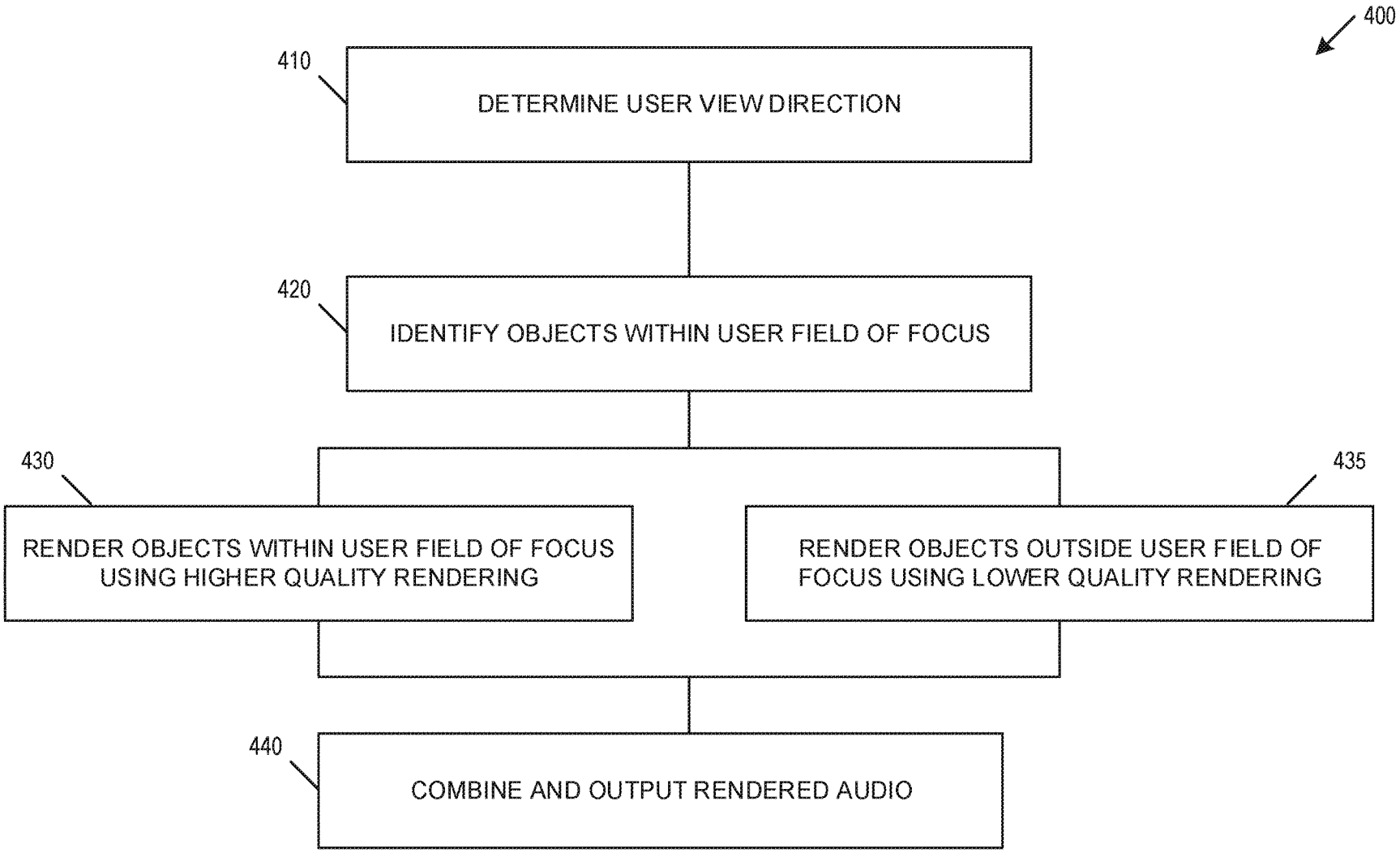
FIG. 4 is a diagram of a sound rendering system method, according to an embodiment.

FIG. 4 is a diagram of a sound rendering system method 400, according to an embodiment. Method 400 may include determining a user view direction 410. The user view direction 410 may be determined to be in front of a user location, or may be modified to include a user view direction 410 based on an interactive direction input (e.g., video game controller), an eye-tracking device, or other input. Method 400 may identify one or more audio objects with a user field of focus 420. Method 400 may include rendering objects within a user field of focus with a higher quality rendering 430, and may include rendering objects outside the user field of focus with a lower quality rendering 435. Additional regions of user focus and additional rendering qualities may be used, such as described above. Method 400 may include combining one or more rendered audio objects to be output to a user. In an embodiment, method 400 may be implemented within software or within a software development kit (SDK) to provide access to method 400. While these various regions of use focus may be used to provide this staggered audio implementation complexity, simulated physical speaker locations may be used, such as shown and described with respect to FIG. 5.

Figure 5:
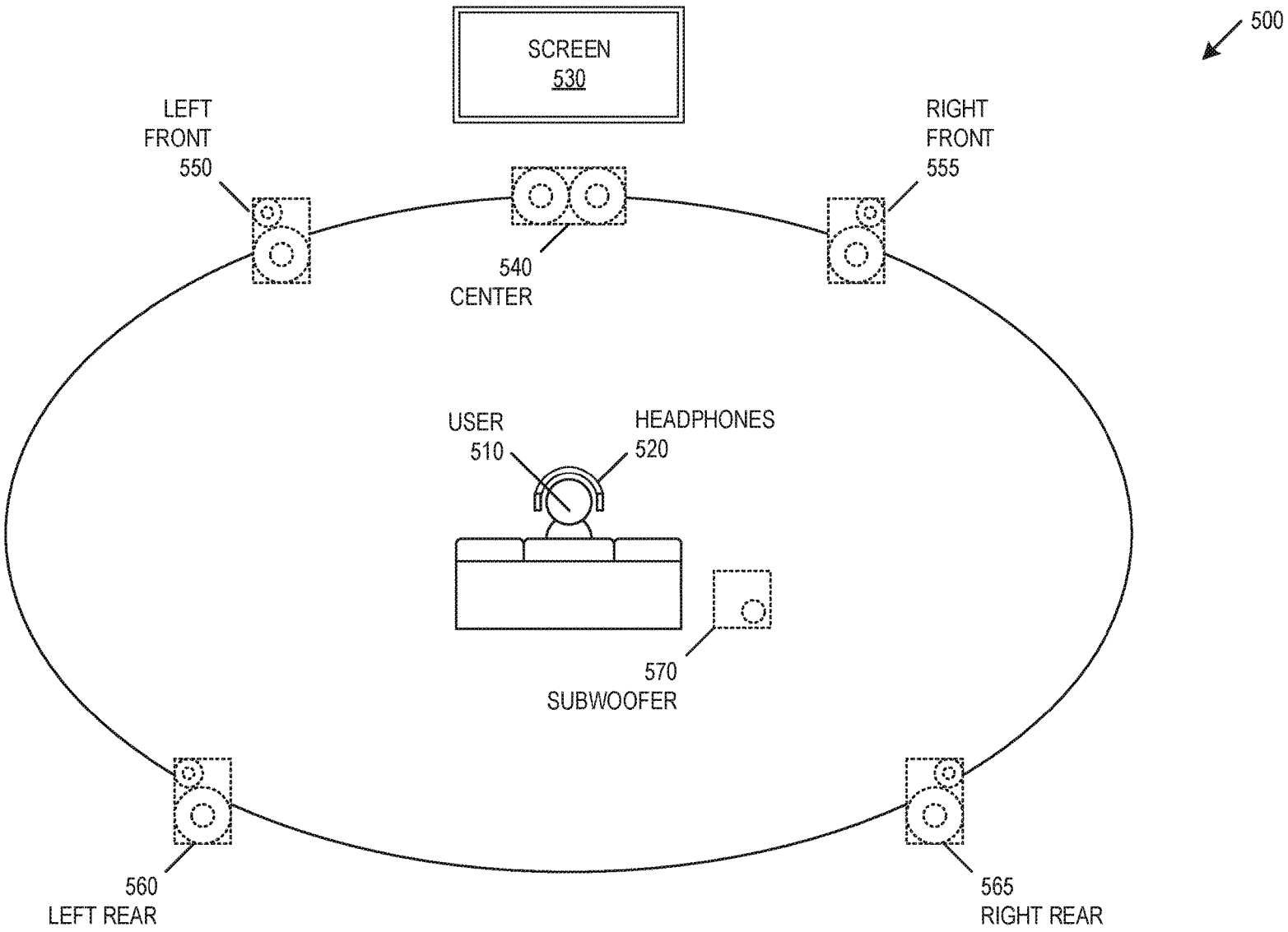
FIG. 5 is a diagram of virtual surround system, according to an example embodiment.

FIG. 5 is a diagram of virtual surround system 500, according to an example embodiment. Virtual surround system 500 is an example system that could apply the staggered audio implementation complexity described above to a set of virtual surround sound sources. Virtual surround system 500 may provide simulated surround sound for a user 510, such as through binaural headphones 520. The user may use the headphones 520 while viewing a video on a screen 530. Virtual surround system 500 may be used to provide multiple simulated surround channels, such as may be used to provide simulated 5.1 surround sound. System 500 may include a virtual center channel 540, which may simulated to be positioned close to screen 530. System 500 may include pairs of virtual left and right speakers, including a virtual left front speaker 550, a virtual right front speaker 555, a virtual left rear speaker 560, a virtual right rear speaker 565, and a virtual subwoofer 570. While virtual surround system 500 is shown to provide simulated 5.1 surround sound, system 500 may be used to simulate 7.1, 11.1, 22.2, or other surround sound configurations.

The staggered audio implementation complexity described above may be applied to the set of virtual surround sound sources in virtual surround system 500. A sound source may have an associated set of 5.1 audio channels, and virtual surround system 500 may be used to provide optimum simulated audio rendering in the regions centered at the virtual locations of each of the 5.1 virtual speakers. In an example, the complex frequency-domain interpolation of individualized HRTFs may be used at the location of each of the virtual speakers, and the linear time-domain HRTF interpolation with per-source ITDs may be used between any of the virtual speakers. The virtual speaker location may be used in combination with regions of focus to determine simulated audio rendering. In an example, the complex frequency-domain interpolation of individualized HRTFs may be used at the location of front virtual speakers 540, 550, and 555, the linear time-domain HRTF interpolation with per-source ITDs may be used between front virtual speakers 540, 550, and 555 within the user's overall field of view, and virtual loudspeakers may be used for rear virtual speakers 560 and 565 and subwoofer 570.

This disclosure has been described in detail and with reference to exemplary embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

The present subject matter concerns processing audio signals (i.e., signals representing physical sound). These audio signals are represented by digital electronic signals. In describing the embodiments, analog waveforms may be shown or discussed to illustrate the concepts. However, it should be understood that typical embodiments of the present subject matter would operate in the context of a time series of digital bytes or words, where these bytes or words form a discrete approximation of an analog signal or ultimately a physical sound. The discrete, digital signal corresponds to a digital representation of a periodically sampled audio waveform. For uniform sampling, the waveform is to be sampled at or above a rate sufficient to satisfy the Nyquist sampling theorem for the frequencies of interest. In a typical embodiment, a uniform sampling rate of approximately 44,100 samples per second (e.g., 44.1 kHz) may be used, however higher sampling rates (e.g., 96 kHz, 128 kHz) may alternatively be used. The quantization scheme and bit resolution should be chosen to satisfy the requirements of a particular application, according to standard digital signal processing techniques. The techniques and apparatus of the present subject matter typically would be applied interdependently in a number of channels. For example, it could be used in the context of a "surround" audio system (e.g., having more than two channels).

As used herein, a "digital audio signal" or "audio signal" does not describe a mere mathematical abstraction, but instead denotes information embodied in or carried by a physical medium capable of detection by a machine or apparatus. These terms includes recorded or transmitted signals, and should be understood to include conveyance by any form of encoding, including pulse code modulation (PCM) or other encoding. Outputs, inputs, or intermediate audio signals could be encoded or compressed by any of various known methods, including MPEG, ATRAC, AC3, or the proprietary methods of DTS, Inc. as described in U.S. Pat. Nos. 5,974,380; 5,978,762; and 6,487,535. Some modification of the calculations may be required to accommodate a particular compression or encoding method, as will be apparent to those with skill in the art.

In software, an audio "codec" includes a computer program that formats digital audio data according to a given audio file format or streaming audio format. Most codecs are implemented as libraries that interface to one or more multimedia players, such as QuickTime Player, XMMS, Winamp, Windows Media Player, Pro Logic, or other codecs. In hardware, audio codec refers to a single or multiple devices that encode analog audio as digital signals and decode digital back into analog. In other words, it contains both an analog-to-digital converter (ADC) and a digital-to-analog converter (DAC) running off a common clock.

An audio codec may be implemented in a consumer electronics device, such as a DVD player, Blu-Ray player, TV tuner, CD player, handheld player, Internet audio/video device, gaming console, mobile phone, or another electronic device. A consumer electronic device includes a Central Processing Unit (CPU), which may represent one or more conventional types of such processors, such as an IBM PowerPC, Intel Pentium (x86) processors, or other processor. A Random Access Memory (RAM) temporarily stores results of the data processing operations performed by the CPU, and is interconnected thereto typically via a dedicated memory channel. The consumer electronic device may also include permanent storage devices such as a hard drive, which are also in communication with the CPU over an input/output (I/O) bus. Other types of storage devices such as tape drives, optical disk drives, or other storage devices may also be connected. A graphics card may also be connected to the CPU via a video bus, where the graphics card transmits signals representative of display data to the display monitor. External peripheral data input devices, such as a keyboard or a mouse, may be connected to the audio reproduction system over a USB port. A USB controller translates data and instructions to and from the CPU for external peripherals connected to the USB port. Additional devices such as printers, microphones, speakers, or other devices may be connected to the consumer electronic device.

The consumer electronic device may use an operating system having a graphical user interface (GUI), such as WINDOWS from Microsoft Corporation of Redmond, Wash., MAC OS from Apple, Inc. of Cupertino, Calif., various versions of mobile GUIs designed for mobile operating systems such as Android, or other operating systems. The consumer electronic device may execute one or more computer programs. Generally, the operating system and computer programs are tangibly embodied in a computer-readable medium, where the computer-readable medium includes one or more of the fixed or removable data storage devices including the hard drive. Both the operating system and the computer programs may be loaded from the aforementioned data storage devices into the RAM for execution by the CPU. The computer programs may comprise instructions, which when read and executed by the CPU, cause the CPU to perform the steps to execute the steps or features of the present subject matter.

The audio codec may include various configurations or architectures. Any such configuration or architecture may be readily substituted without departing from the scope of the present subject matter. A person having ordinary skill in the art will recognize the above-described sequences are the most commonly used in computer-readable mediums, but there are other existing sequences that may be substituted without departing from the scope of the present subject matter.

Elements of one embodiment of the audio codec may be implemented by hardware, firmware, software, or any combination thereof. When implemented as hardware, the audio codec may be employed on a single audio signal processor or distributed amongst various processing components. When implemented in software, elements of an embodiment of the present subject matter may include code segments to perform the necessary tasks. The software preferably includes the actual code to carry out the operations described in one embodiment of the present subject matter, or includes code that emulates or simulates the operations. The program or code segments can be stored in a processor or machine accessible medium or transmitted by a computer data signal embodied in a carrier wave (e.g., a signal modulated by a carrier) over a transmission medium. The "processor readable or accessible medium" or "machine readable or accessible medium" may include any medium that can store, transmit, or transfer information.

Examples of the processor readable medium include an electronic circuit, a semiconductor memory device, a read only memory (ROM), a flash memory, an erasable programmable ROM (EPROM), a floppy diskette, a compact disk (CD) ROM, an optical disk, a hard disk, a fiber optic medium, a radio frequency (RF) link, or other media. The computer data signal may include any signal that can propagate over a transmission medium such as electronic network channels, optical fibers, air, electromagnetic, RF links, or other transmission media. The code segments may be downloaded via computer networks such as the Internet, Intranet, or another network. The machine accessible medium may be embodied in an article of manufacture. The machine accessible medium may include data that, when accessed by a machine, cause the machine to perform the operation described in the following. The term "data" here refers to any type of information that is encoded for machine-readable purposes, which may include program, code, data, file, or other information.

Embodiments of the present subject matter may be implemented by software. The software may include several modules coupled to one another. A software module is coupled to another module to generate, transmit, receive, or process variables, parameters, arguments, pointers, results, updated variables, pointers, or other inputs or outputs. A software module may also be a software driver or interface to interact with the operating system being executed on the platform. A software module may also be a hardware driver to configure, set up, initialize, send, or receive data to or from a hardware device.

Embodiments of the present subject matter may be described as a process that is usually depicted as a flowchart, a flow diagram, a structure diagram, or a block diagram. Although a block diagram may describe the operations as a sequential process, many of the operations can be performed in parallel or concurrently. In addition, the order of the operations may be rearranged. A process may be terminated when its operations are completed. A process may correspond to a method, a program, a procedure, or other group of steps.

This description includes a method and apparatus for synthesizing audio signals, particularly in loudspeakers or headphone (e.g., headset) applications. While aspects of the disclosure are presented in the context of exemplary systems that include loudspeakers or headsets, it should be understood that the described methods and apparatus are not limited to such systems and that the teachings herein are applicable to other methods and apparatus that include synthesizing audio signals. As used in the description of embodiments, audio objects include 3D positional data. Thus, an audio object should be understood to include a particular combined representation of an audio source with 3D positional data, which is typically dynamic in position. In contrast, a "sound source" is an audio signal for playback or reproduction in a final mix or render and it has an intended static or dynamic rendering method or purpose. For example, a source may be the signal "Front Left" or a source may be played to the low frequency effects ("LFE") channel or panned 90 degrees to the right.

To better illustrate the method and apparatuses disclosed herein, a non-limiting list of embodiments is provided here.

Example 1 is a sound rendering system comprising: one or more processors; a storage device comprising instructions, which when executed by the one or more processors, configure the one or more processors to: render a first sound signal using a first rendering quality, the first sound signal associated with a first sound source within a central visual region; and render a second sound signal using a second rendering quality, the second sound signal associated with a second sound source within a peripheral visual region, wherein the first rendering quality is greater than the second rendering quality.

In Example 2, the subject matter of Example 1 optionally includes wherein: the first rendering quality includes a complex frequency-domain interpolation of individualized head-related transfer functions (HRTFs); and the second rendering quality includes a linear time-domain IRTF interpolation with per-source interaural time differences (ITDs).

In Example 3, the subject matter of any one or more of Examples 1-2 optionally include wherein: the central visual region is associated with a central visual acuity; the peripheral visual region is associated with a peripheral visual acuity; and the central visual acuity is greater than the peripheral visual acuity.

In Example 4, the subject matter of Example 3 optionally includes wherein: the central visual region includes a central conical region in a user gaze direction; and the peripheral visual region includes a peripheral conical region within a user field of view and outside the central conical region.

In Example 5, the subject matter of any one or more of Examples 3-4 optionally include the instructions further configuring the one or more processors to render a transition sound signal using a transition rendering quality, the transition sound signal associated with a transition sound source within a transition border region, the transition border region shared by the central conical region and the peripheral conical region along the perimeter of the central conical region, wherein the transition rendering quality provides a seamless audio quality transition between the first rendering quality and the second rendering quality.

In Example 6, the subject matter of Example 5 optionally includes wherein the transition border region is selected to include an HRTF sampling location.

In Example 7, the subject matter of Example 6 optionally includes wherein a common ITD is applied at the transition border region.

In Example 8, the subject matter of any one or more of Examples 1-7 optionally include the instructions further configuring the one or more processors to render a third sound signal using a third rendering quality, the third sound signal associated with a third sound source within a non-visible region outside of the peripheral visual region, wherein the second rendering quality is greater than the third rendering quality.

In Example 9, the subject matter of Example 8 optionally includes wherein the third rendering quality includes a virtual loudspeaker rendering.

In Example 10, the subject matter of any one or more of Examples 1-9 optionally include the instructions further configuring the one or more processors to: generate a mixed output signal based on the first sound signal and second sound signal; and output the mixed output signal to an audible sound reproduction device.

In Example 11, the subject matter of Example 10 optionally includes wherein: the audible sound reproduction device includes a binaural sound reproduction device; rendering the first sound signal using the first rendering quality includes rendering the first sound signal to a first binaural audio signal using a first head related transfer function (HRTF): and rendering the second sound signal using the second rendering quality includes rendering the second sound signal to a second binaural audio signal using a second HRTF.

Example 12 is a sound rendering method comprising: rendering a first sound signal using a first rendering quality, the first sound signal associated with a first sound source within a central visual region; and rendering a second sound signal using a second rendering quality, the second sound signal associated with a second sound source within a peripheral visual region, wherein the first rendering quality is greater than the second rendering quality.

In Example 13, the subject matter of Example 12 optionally includes wherein: the first rendering quality includes a complex frequency-domain interpolation of individualized head-related transfer functions (HRTFs); and the second rendering quality includes a linear time-domain HRTF interpolation with per-source interaural time differences (ITDs).

In Example 14, the subject matter of any one or more of Examples 12-13 optionally include wherein: the central visual region is associated with a central visual acuity; the peripheral visual region is associated with a peripheral visual acuity; and the central visual acuity is greater than the peripheral visual acuity.

In Example 15, the subject matter of Example 14 optionally includes wherein: the central visual region includes a central conical region in a user gaze direction; and the peripheral visual region includes a peripheral conical region within a user field of view and outside the central conical region.

In Example 16, the subject matter of any one or more of Examples 14-15 optionally include rendering a transition sound signal using a transition rendering quality, the transition sound signal associated with a transition sound source within a transition border region, the transition border region shared by the central conical region and the peripheral conical region along the perimeter of the central conical region, wherein the transition rendering quality provides a seamless audio quality transition between the first rendering quality and the second rendering quality.

In Example 17, the subject matter of Example 16 optionally includes wherein the transition border region is selected to include an HRTF sampling location.

In Example 18, the subject matter of any one or more of Examples 16-17 optionally include wherein a common ITD is applied at the transition border region.

In Example 19, the subject matter of any one or more of Examples 12-18 optionally include rendering a third sound signal using a third rendering quality, the third sound signal associated with a third sound source within a non-visible region outside of the peripheral visual region, wherein the second rendering quality is greater than the third rendering quality.

In Example 20, the subject matter of Example 19 optionally includes wherein the third rendering quality includes a virtual loudspeaker rendering.

In Example 21, the subject matter of any one or more of Examples 12-20 optionally include generating a mixed output signal based on the first sound signal and second sound signal; and outputting the mixed output signal to an audible sound reproduction device.

In Example 22, the subject matter of Example 21 optionally includes wherein: the audible sound reproduction device includes a binaural sound reproduction device; the rendering of the first sound signal using the first rendering quality includes rendering the first sound signal to a first binaural audio signal using a first head related transfer function (HRTF): and the rendering of the second sound signal using the second rendering quality includes rendering the second sound signal to a second binaural audio signal using a second HRTF.

Example 23 is one or more machine-readable medium including instructions, which when executed by a computing system, cause the computing system to perform any of the methods of Examples 12-22.

Example 24 is an apparatus comprising means for performing any of the methods of Examples 12-22.

Example 25 is a machine-readable storage medium comprising a plurality of instructions that, when executed with a processor of a device, cause the device to: render a first sound signal using a first rendering quality, the first sound signal associated with a first sound source within a central visual region; and render a second sound signal using a second rendering quality, the second sound signal associated with a second sound source within a peripheral visual region, wherein the first rendering quality is greater than the second rendering quality.

In Example 26, the subject matter of Example 25 optionally includes wherein: the first rendering quality includes a complex frequency-domain interpolation of individualized head-related transfer functions (HRTFs); and the second rendering quality includes a linear time-domain HRTF interpolation with per-source interaural time differences (ITDs).

In Example 27, the subject matter of any one or more of Examples 25-26 optionally include wherein: the central visual region is associated with a central visual acuity; the peripheral visual region is associated with a peripheral visual acuity; and the central visual acuity is greater than the peripheral visual acuity.

In Example 28, the subject matter of Example 27 optionally includes wherein: the central visual region includes a central conical region in a user gaze direction; and the peripheral visual region includes a peripheral conical region within a user field of view and outside the central conical region.

In Example 29, the subject matter of any one or more of Examples 27-28 optionally include the instructions further causing the device to render a transition sound signal using a transition rendering quality, the transition sound signal associated with a transition sound source within a transition border region, the transition border region shared by the central conical region and the peripheral conical region along the perimeter of the central conical region, wherein the transition rendering quality provides a seamless audio quality transition between the first rendering quality and the second rendering quality.

In Example 30, the subject matter of Example 29 optionally includes wherein the transition border region is selected to include an HRTF sampling location.

In Example 31, the subject matter of anyone or more of Examples 29-30 optionally include wherein a common ITD is applied at the transition border region.

In Example 32, the subject matter of any one or more of Examples 25-31 optionally include the instructions further causing the device to render a third sound signal using a third rendering quality, the third sound signal associated with a third sound source within a non-visible region outside of the peripheral visual region, wherein the second rendering quality is greater than the third rendering quality.

In Example 33, the subject matter of Example 32 optionally includes wherein the third rendering quality includes a virtual loudspeaker rendering.

In Example 34, the subject matter of any one or more of Examples 25-33 optionally include the instructions further causing the device to: generate a mixed output signal based on the first sound signal and second sound signal; and output the mixed output signal to an audible sound reproduction device.

In Example 35, the subject matter of Example 34 optionally includes wherein: the audible sound reproduction device includes a binaural sound reproduction device; the rendering of the first sound signal using the first rendering quality includes rendering the first sound signal to a first binaural audio signal using a first head related transfer function (RTF): and the rendering of the second sound signal using the second rendering quality includes rendering the second sound signal to a second binaural audio signal using a second HRTF.

Example 36 is a sound rendering apparatus comprising: rendering a first sound signal using a first rendering quality, the first sound signal associated with a first sound source within a central visual region; and rendering a second sound signal using a second rendering quality, the second sound signal associated with a second sound source within a peripheral visual region, wherein the first rendering quality is greater than the second rendering quality.

In Example 37, the subject matter of Example 36 optionally includes wherein: the first rendering quality includes a complex frequency-domain interpolation of individualized head-related transfer functions (HRTFs); and the second rendering quality includes a linear time-domain HRTF interpolation with per-source interaural time differences (ITDs).

In Example 38, the subject matter of any one or more of Examples 36-37 optionally include wherein: the central visual region is associated with a central visual acuity; the peripheral visual region is associated with a peripheral visual acuity; and the central visual acuity is greater than the peripheral visual acuity.

In Example 39, the subject matter of Example 38 optionally includes wherein: the central visual region includes a central conical region in a user gaze direction; and the peripheral visual region includes a peripheral conical region within a user field of view and outside the central conical region.

In Example 40, the subject matter of any one or more of Examples 38-39 optionally include rendering a transition sound signal using a transition rendering quality, the transition sound signal associated with a transition sound source within a transition border region, the transition border region shared by the central conical region and the peripheral conical region along the perimeter of the central conical region, wherein the transition rendering quality provides a seamless audio quality transition between the first rendering quality and the second rendering quality.

In Example 41, the subject matter of Example 40 optionally includes wherein the transition border region is selected to include an HRTF sampling location.

In Example 42, the subject matter of any one or more of Examples 40-41 optionally include wherein a common ITD is applied at the transition border region.

In Example 43, the subject matter of any one or more of Examples 39-42 optionally include rendering a third sound signal using a third rendering quality, the third sound signal associated with a third sound source within a non-visible region outside of the peripheral visual region, wherein the second rendering quality is greater than the third rendering quality.

In Example 44, the subject matter of Example 43 optionally includes wherein the third rendering quality includes a virtual loudspeaker rendering.

In Example 45, the subject matter of any one or more of Examples 36-44 optionally include generating a mixed output signal based on the first sound signal and second sound signal; and outputting the mixed output signal to an audible sound reproduction device.

In Example 46, the subject matter of Example 45 optionally includes wherein: the audible sound reproduction device includes a binaural sound reproduction device; the rendering of the first sound signal using the first rendering quality includes rendering the first sound signal to a first binaural audio signal using a first head related transfer function (HRTF): and the rendering of the second sound signal using the second rendering quality includes rendering the second sound signal to a second binaural audio signal using a second HRTF.

Example 47 is one or more machine-readable medium including instructions, which when executed by a machine, cause the machine to perform operations of any of the operations of Examples 1-46.

Example 48 is an apparatus comprising means for performing any of the operations of Examples 1-46.

Example 49 is a system to perform the operations of any of the Examples 1-46.

Example 50 is a method to perform the operations of any of the Examples 1-46.

The above detailed description includes references to the accompanying drawings, which form a part of the detailed description. The drawings show specific embodiments by way of illustration. These embodiments are also referred to herein as "examples." Such examples can include elements in addition to those shown or described. Moreover, the subject matter may include any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to quickly ascertain the nature of the technical disclosure. It is submitted with the understanding that it will not be used to interpret or limit the scope or meaning of the claims. In the above Detailed Description, various features may be grouped together to streamline the disclosure. This should not be interpreted as intending that an unclaimed disclosed feature is essential to any claim. Rather, the subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope should be determined with reference to the appended claims, along with the full scope of equivalents to which such claims are entitled.

What is claimed is:

1. A sound rendering system comprising:

one or more processors;

a storage device comprising instructions, which when executed by the one or more processors, configure the one or more processors to:

render a first sound signal using a first rendering quality, the first sound signal associated with a first sound source within a central visual region, the first rendering quality including a complex frequency-domain interpolation of individualized head-related transfer functions (HRTFs); and render a second sound signal using a second rendering quality, the second sound signal associated with a second sound source within a peripheral visual region, the second rendering quality including a linear time-domain HRTF interpolation with interaural time differences (ITDs) calculated for each source, wherein the first rendering quality is greater than the second rendering quality.

2. The system of claim 1, wherein:

the central visual region is associated with a central visual acuity;

the peripheral visual region is associated with a peripheral visual acuity; and the central visual acuity is greater than the peripheral visual acuity.

3. The system of claim 2, wherein:

the central visual region includes a central conical region in a user gaze direction; and the peripheral visual region includes a peripheral conical region within a user field of view and outside the central conical region.

4. The system of claim 2, the instructions further configuring the one or more processors to render a transition sound signal using a transition rendering quality, the transition sound signal associated with a transition sound source within a transition border region, the transition border region shared by the central conical region and the peripheral conical region along the perimeter of the central conical region, wherein the transition rendering quality provides a seamless audio quality transition between the first rendering quality and the second rendering quality.

5. The system of claim 4, wherein the transition border region is selected to include an HRTF sampling location.

6. The system of claim 5, wherein a common ITD is applied at the transition border region.

7. The system of claim 1, the instructions further configuring the one or more processors to render a third sound signal using a third rendering quality, the third sound signal associated with a third sound source within a non-visible region outside of the peripheral visual region, wherein the second rendering quality is greater than the third rendering quality.

8. The system of claim 7, wherein the third rendering quality includes a virtual loudspeaker rendering.

9. The system of claim 1, the instructions further configuring the one or more processors to:

generate a mixed output signal based on the first sound signal and second sound signal; and output the mixed output signal to an audible sound reproduction device.

10. The system of claim 9, wherein:

the audible sound reproduction device includes a binaural sound reproduction device;

rendering the first sound signal using the first rendering quality includes rendering the first sound signal to a first binaural audio signal using a first head related transfer function (HRTF): and rendering the second sound signal using the second rendering quality includes rendering the second sound signal to a second binaural audio signal using a second RTF.

11. A sound rendering method comprising:

rendering a first sound signal using a first rendering quality, the first sound signal associated with a first sound source within a central visual region, the first rendering quality including a complex frequency-domain interpolation of individualized head-related transfer functions (HRTFs); and rendering a second sound signal using a second rendering quality, the second sound signal associated with a second sound source within a peripheral visual region, the second rendering quality including a linear time-domain HRTF interpolation with interaural time differences (ITDs) calculated for each source, wherein the first rendering quality is greater than the second rendering quality.

12. The method of claim 11, wherein:

the central visual region is associated with a central visual acuity;

the peripheral visual region is associated with a peripheral visual acuity; and the central visual acuity is greater than the peripheral visual acuity.

13. The method of claim 12, wherein:

the central visual region includes a central conical region in a user gaze direction; and the peripheral visual region includes a peripheral conical region within a user field of view and outside the central conical region.

14. The method of claim 12, further including rendering a transition sound signal using a transition rendering quality, the transition sound signal associated with a transition sound source within a transition border region, the transition border region shared by the central conical region and the peripheral conical region along the perimeter of the central conical region, wherein the transition rendering quality provides a seamless audio quality transition between the first rendering quality and the second rendering quality.

15. The method of claim 14, wherein the transition border region is selected to include an HRTF sampling location.

16. The method of claim 14, wherein a common ITD is applied at the transition border region.

17. The method of claim 11, further including rendering a third sound signal using a third rendering quality, the third sound signal associated with a third sound source within a non-visible region outside of the peripheral visual region, wherein the second rendering quality is greater than the third rendering quality.

18. The method of claim 17, wherein the third rendering quality includes a virtual loudspeaker rendering.

19. The method of claim 11, further including:

generating a mixed output signal based on the first sound signal and second sound signal; and outputting the mixed output signal to an audible sound reproduction device.

20. The method of claim 19, wherein:

the audible sound reproduction device includes a binaural sound reproduction device;

the rendering of the first sound signal using the first rendering quality includes rendering the first sound signal to a first binaural audio signal using a first head related transfer function (HRTF): and the rendering of the second sound signal using the second rendering quality includes rendering the second sound signal to a second binaural audio signal using a second HRTF.

21. A machine-readable storage medium comprising a plurality of instructions that, when executed with a processor of a device, cause the device to:

render a first sound signal using a first rendering quality, the first sound signal associated with a first sound source within a central visual region, the first rendering quality including a complex frequency-domain interpolation of individualized head-related transfer functions (HRTFs); and render a second sound signal using a second rendering quality, the second sound signal associated with a second sound source within a peripheral visual region, the second rendering quality including a linear time-domain HRTF interpolation with interaural time differences (ITDs) calculated for each source, wherein the first rendering quality is greater than the second rendering quality.

22. The machine-readable storage medium of claim 21, the instructions further causing the device to render a third sound signal using a third rendering quality, the third sound signal associated with a third sound source within a non-visible region outside of the peripheral visual region, wherein the second rendering quality is greater than the third rendering quality.

23. The machine-readable storage medium of claim 21, the instructions further causing the device to:

generate a mixed output signal based on the first sound signal and second sound signal; and output the mixed output signal to an audible sound reproduction device.

* * * * *